US010451389B2

(12) United States Patent
Urban

(10) Patent No.: US 10,451,389 B2
(45) Date of Patent: Oct. 22, 2019

(54) PORTABLE TARGET SYSTEM

(71) Applicant: Robert Francis Urban, Woodland Park, CO (US)

(72) Inventor: Robert Francis Urban, Woodland Park, CO (US)

( * ) Notice: Subject to any disclaimer, the term of this patent is extended or adjusted under 35 U.S.C. 154(b) by 0 days.

(21) Appl. No.: 15/693,247

(22) Filed: Aug. 31, 2017

(65) Prior Publication Data

US 2018/0058827 A1 Mar. 1, 2018

Related U.S. Application Data

(60) Provisional application No. 62/495,049, filed on Sep. 1, 2016.

(51) Int. Cl.
*F41J 1/10* (2006.01)

(52) U.S. Cl.
CPC ..... *F41J 1/10* (2013.01)

(58) Field of Classification Search
CPC ..... F41J 1/00; F41J 1/10
USPC ..... 273/403–408
See application file for complete search history.

(56) References Cited

U.S. PATENT DOCUMENTS 2,372,111 A * 3/1945 Norberg ..... F41J 1/10 160/201
2,538,118 A * 1/1951 Miller ..... F41J 1/10 248/156
3,540,729 A * 11/1970 Rahberger ..... F41J 1/10 248/156
3,601,353 A * 8/1971 Dale ..... F41J 1/10 160/327
5,163,689 A * 11/1992 Bateman ..... F41J 1/10 273/403
5,524,881 A * 6/1996 Edward ..... A63B 63/08 273/400
5,671,924 A * 9/1997 Scott ..... F41J 1/10 273/395
7,374,173 B2 * 5/2008 Nasuti ..... F41J 1/10 273/403
7,815,192 B1 * 10/2010 Kreiman ..... F41J 9/02 273/390
2009/0256314 A1 * 10/2009 Kobett ..... F41J 1/10 273/407
2010/0225063 A1 * 9/2010 Wyrick ..... F41J 1/10 273/390
2011/0042901 A1 * 2/2011 Raymond ..... A63B 63/007 273/407
2015/0069709 A1 * 3/2015 Doria ..... F41J 1/10 273/407
2015/0130136 A1 * 5/2015 Bliehall ..... F41J 5/20 273/391
2015/0260486 A1 * 9/2015 Trimbath ..... F41J 1/10 273/407
2015/0330748 A1 * 11/2015 Anzalone ..... F41J 1/10 273/390

* cited by examiner

*Primary Examiner* — Mark S Graham
(74) *Attorney, Agent, or Firm* — Faegre Baker Daniels LLP

(57) ABSTRACT

A target system includes a lower rod configured to be removably inserted, at a lower end, into the ground; and an upper rod assembly. The upper rod assembly includes an upper rod configured to be coupled, at a lower end, to an upper end of the lower rod. The upper rod assembly also includes a mounting assembly coupled to an upper end of the upper rod and configured to hold a target.

13 Claims, 5 Drawing Sheets

PORTABLE TARGET SYSTEM

CROSS REFERENCE TO RELATED APPLICATION

This application claims the benefit under 35 U.S.C. § 119 of U.S. Provisional Application No. 62/495,049, filed Sep. 1, 2016, entitled "Portable Multi-Purpose Shooting Target Stand/Holder FOR Use with Empty Common Household Containers and Many Other Common Items Too Numerous to List," which is hereby incorporated by reference in its entirety.

TECHNICAL FIELD

Embodiments of the present disclosure relate to target systems. More specifically, embodiments of the disclosure relate to portable target systems for facilitating target practice.

BACKGROUND

Target shooting often involves shooting at a variety of targets like cans, bottles, and other household items. Setting up targets of this nature often involves setting them on the ground, propping them up against fences, and/or the like.

SUMMARY

Embodiments of the disclosure include target systems for facilitating target practice with a projectile-shooting device such as, for example, a firearm, a bow, a crossbow, and/or the like. In embodiments, for example, a target system may include a target practice kit that includes a set of parts of a target system and a portable container configured to contain the set of parts. The set of parts may include a lower rod configured to be removably inserted, at a lower end, into the ground, and an upper rod assembly. The upper rod assembly may include an upper rod configured to be coupled, at a lower end, to an upper end of the lower rod; and a mounting assembly configured to be coupled to an upper end of the upper rod. In embodiments, the upper rod assembly may also include a shield configured to be coupled to the upper rod to protect the mounting assembly from projectiles.

In an Example 1, a target system, comprises a lower rod configured to be removably inserted, at a lower end, into the ground; and an upper rod assembly, the upper rod assembly comprising: an upper rod configured to be coupled, at a lower end, to an upper end of the lower rod; and a mounting assembly coupled to an upper end of the upper rod.

In an Example 2, the target system of Example 1, the upper rod assembly comprising a first attachment interface disposed at a lower end of the upper rod, wherein the first attachment interface is configured to interact with a second attachment interface, wherein the second attachment interface is disposed at an upper end of the lower rod.

In an Example 3, the target system of either of Examples 1 or 2, wherein the lower rod further includes a tapered lower end configured to facilitate ground penetration.

In an Example 4, the target system of any of Examples 1-3, the lower rod further including a strike surface configured to facilitate hammering the lower rod into the ground.

In an Example 5, the target system of Example 4, wherein the strike surface is an upper surface of a strike barrel, the strike barrel comprising a body having an aperture defined therethrough, the aperture configured to receive an upper portion of the lower rod.

In an Example 6, the target system of Example 5, the lower rod further comprising a stop surface configured to engage a lower surface of the strike barrel body.

In an Example 7, the target system of any of Examples 1-6, the mounting assembly comprising an elastic mounting interface, wherein the elastic mounting interface is configured to be compressible to facilitate providing an interference fit between an outer surface of the elastic mounting interface and an inner surface of a mounted object.

In an Example 8, the target system of Example 7, the mounted object comprising at least one of an attachment assembly and a target.

In an Example 9, the target system of Example 8, the attachment assembly comprising a body and one or more attachment devices coupled to the body.

In an Example 10, the target system of Example 9, the one or more attachment devices comprising at least one of a clip, a nail, and a screw.

In an Example 11, the target system of Example 8, wherein the target comprises at least one of a bottle, a paper plate, a lid, a clay target, and a piece of cardboard.

In an Example 12, the target system of any of Examples 1-11, further comprising a shield coupled to the upper rod and configured to be disposed between a shooter and the mounting assembly.

In an Example 13, the target system of Example 12, wherein, when the shield is coupled to the upper rod, the shield is rotatable about the upper rod.

In an Example 14, the target system of Example 13, wherein the shield is coupled to the upper rod via an attachment element, wherein a first end of the attachment element is coupled to an inside surface of the shield, the attachment element having a grommet disposed within an aperture disposed in the attachment element, wherein the grommet is configured to be disposed around the upper rod.

In an Example 15, a method of assembling a target system comprises: inserting a lower rod into the ground; attaching a shield assembly to an upper rod assembly, the upper rod assembly comprising: an upper rod; and a mounting assembly coupled to an upper end of the upper rod; coupling the upper rod assembly to the lower rod; attaching a target and/or an attachment assembly to the mounting assembly; and swiveling the shield to a position between the mounting assembly and a shooter.

In an Example 16, the method of Example 15, wherein inserting the lower rod into the ground comprises striking, with a hammer, a strike surface configured to facilitate hammering the lower rod into the ground.

In an Example 17, the method of Example 16, wherein the strike surface is an upper surface of a strike barrel, the method further comprising positioning the strike barrel on an upper end of the lower rod, the strike barrel comprising a body having an aperture defined therethrough, the aperture configured to receive an upper portion of the lower rod, the lower rod further comprising a stop surface configured to engage a lower surface of the strike barrel body.

In an Example 18, the method of any of Examples 15-17, wherein the shield is coupled to the upper rod via an attachment element, wherein a first end of the attachment element is coupled to an inside surface of the shield, the attachment element having a grommet disposed within an aperture disposed in the attachment element, wherein the grommet is configured to be disposed around the upper rod, wherein attaching the shield assembly to the upper rod assembly comprises sliding the grommet over a lower end of the upper rod.

In an Example 19, a target practice kit, comprises: a set of parts of a target system, the set of parts comprising: a lower rod configured to be removably inserted, at a lower end, into the ground; and an upper rod assembly, the upper rod assembly comprising an upper rod configured to be coupled, at a lower end, to an upper end of the lower rod; a mounting assembly configured to be coupled to an upper end of the upper rod; and a shield configured to be coupled to the upper rod to protect the mounting assembly from projectiles; and a portable container configured to contain a set of parts of a target system, the set of parts comprising.

In an Example 20, the target practice kit of Example 19, the mounting assembly comprising an elastic mounting interface, wherein the elastic mounting interface is configured to be compressible to facilitate providing an interference fit between an outer surface of the elastic mounting interface and an inner surface of a mounted object.

While multiple embodiments are disclosed, still other embodiments of the presently disclosed subject matter will become apparent to those skilled in the art from the following detailed description, which shows and describes illustrative embodiments of the disclosed subject matter. Accordingly, the drawings and detailed description are to be regarded as illustrative in nature and not restrictive.

Figure 1A:
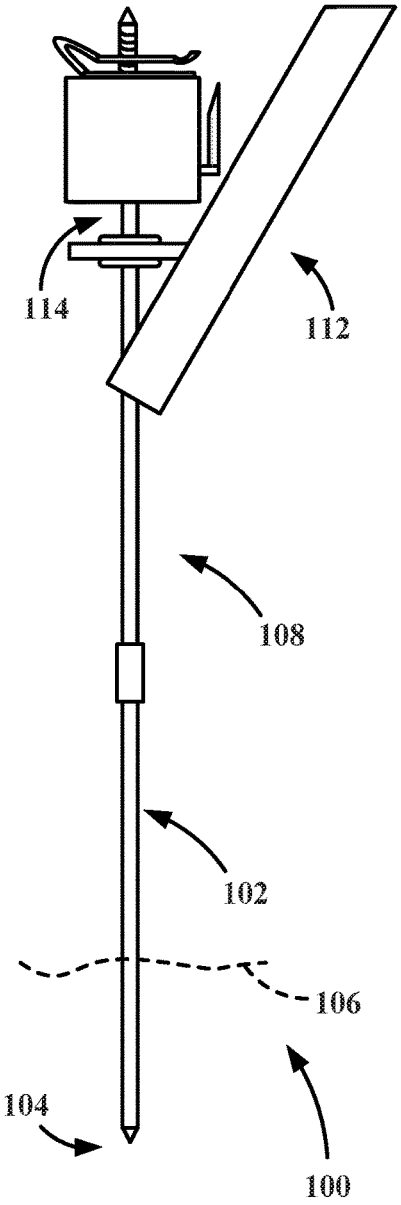
FIG. 1A is a side view of an illustrative target system, in accordance with embodiments of the disclosure.

While the disclosed subject matter is amenable to various modifications and alternative forms, specific embodiments have been shown by way of example in the drawings and are described in detail below. The intention, however, is not to limit the subject matter disclosed herein to the particular embodiments described. On the contrary, the disclosure is intended to cover all modifications, equivalents, and alternatives falling within the scope of the subject matter disclosed herein, and as defined by the appended claims.

Although the term "block" may be used herein to connote different elements illustratively employed, the term should not be interpreted as implying any requirement of, or particular order among or between, various blocks disclosed herein. Similarly, although illustrative methods may be represented by one or more drawings (e.g., flow diagrams, communication flows, etc.), the drawings should not be interpreted as implying any requirement of, or particular order among or between, various steps disclosed herein. However, certain embodiments may require certain steps and/or certain orders between certain steps, as may be explicitly described herein and/or as may be understood from the nature of the steps themselves (e.g., the performance of some steps may depend on the outcome of a previous step). Additionally, a "set," "subset," or "group" of items (e.g., inputs, algorithms, data values, etc.) may include one or more items, and, similarly, a subset or subgroup of items may include one or more items. A "plurality" means more than one.

The terms "up," "upper," and "upward," and variations thereof, are used throughout this disclosure for the sole purpose of clarity of description and are only intended to refer to a relative direction (i.e., a certain direction that is to be distinguished from another direction), and are not meant to be interpreted to mean an absolute direction. Similarly, the terms "down," "lower," and "downward," and variations thereof, are used throughout this disclosure for the sole purpose of clarity of description and are only intended to refer to a relative direction that is at least approximately opposite a direction referred to by one or more of the terms "up," "upper," and "upward," and variations thereof.

DETAILED DESCRIPTION

Figure 1B:
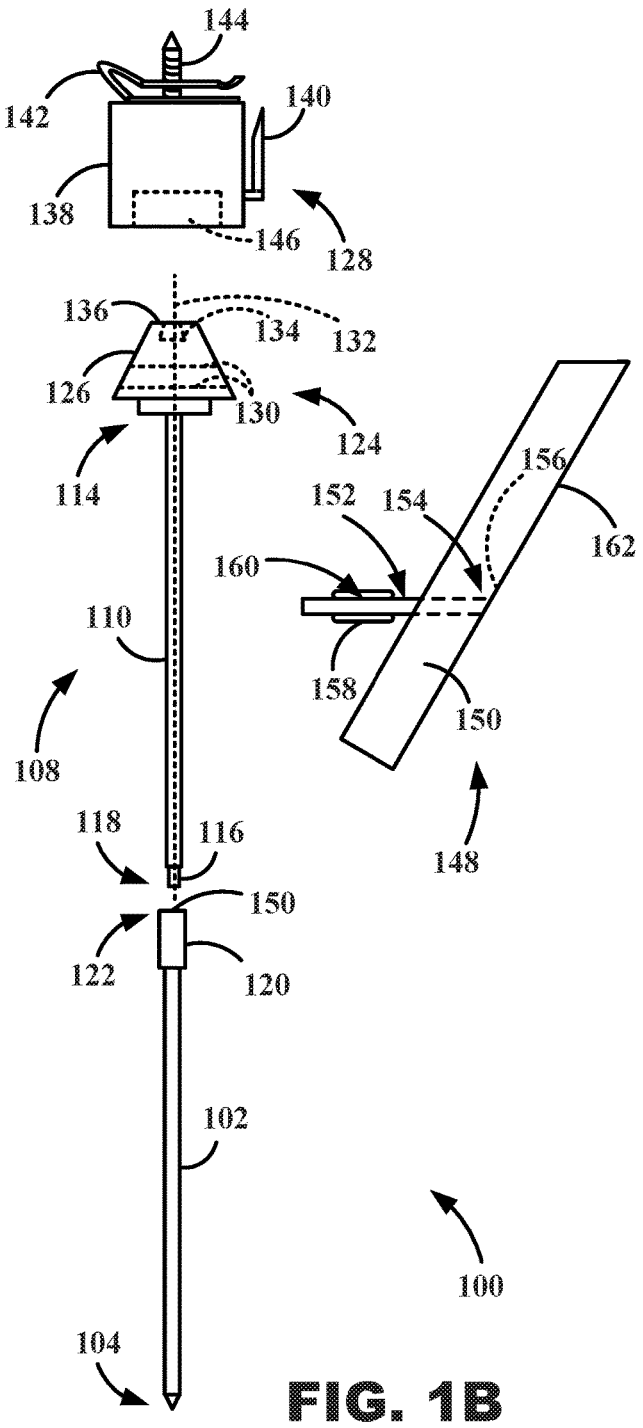
FIG. 1B is a partially-exploded side view of the illustrative target system depicted in FIG. 1A, in accordance with embodiments of the disclosure.

FIG. 1A depicts a side view of an illustrative target system 100, in accordance with embodiments of the subject matter disclosed herein; and FIG. 1B depicts a partially-exploded side view of the illustrative target system 100 depicted in FIG. 1A, in accordance with embodiments of the subject matter disclosed herein. As shown in FIGS. 1A and 1B, the target system 100 includes a lower rod 102 configured to be removably inserted, at a tapered and/or pointed lower end 104, into the ground 106; and an upper rod assembly 108 configured to be coupled to the lower rod 102. As shown, for example, the upper rod assembly 108 may include an upper rod 110 configured to be coupled to the lower rod 102; and a mounting assembly 112 coupled to an upper end 114 of the upper rod 110.

As shown, embodiments of the upper rod assembly 108 may include a first attachment interface 116 disposed at a lower end 118 of the upper rod 110, where the first attachment interface 116 is configured to interact with a second attachment interface 120, which is disposed at an upper end 122 of the lower rod 102. In embodiments, for example, the first and second attachment interfaces 116 and 120 may include threads configured to mate. In embodiments, the first and second attachment interfaces may be configured to interact via an interference fit. That is, for example, the second attachment interface 120 may include an aperture configured to receive the first attachment interface 116 (which may, in embodiments, be the lower end of the upper rod 110), and may be sized so as to provide an interference fit, threaded to provide a screw fit, and/or the like. According to embodiments, any number of different attachment mechanisms may be used to couple the upper rod assembly 108 to the lower rod 102. In embodiments, the second attachment interface 120 may be threaded (e.g., permanently threaded) onto the upper end 122 of the lower rod 102, and may be milled out to facilitate a pressure fit with the lower end of the upper rod 110. In embodiments, a strike barrel, as described below, may be used to prevent direct hammering on the second attachment interface 120, which could cause damage and/or deformation to the second attachment interface 120, thereby hindering the ability of the two rods to couple.

In embodiments, the second attachment interface 120 may be one or more surfaces of the lower rod 102. That is, for example, in embodiments, the upper end 122 of the lower rod 102 may include an opening disposed therein having an inner surface that is threaded, configured for facilitating an interference fit with the upper rod 110, and/or the like. In embodiments, the upper rod 110 and lower rod 102 may be pre-assembled—that is, for example, the upper rod 110 and the lower rod 102 may be removably or fixedly coupled together during manufacture. In some embodiments, the upper rod 110 and the lower rod 102 may be integrated (e.g., such that there is only one rod).

As is further shown in FIGS. 1A and 1B, the mounting assembly 112 may include an elastic mounting interface 124, where the elastic mounting interface 124 is configured to be compressible to facilitate providing an interference fit between an outer surface 126 of the elastic mounting interface 124 and an inner surface of a mounted object. The elastic mounting interface 124 may be made of any number of different compressible materials such as, for example, rubber. In embodiments, for example, the mounted object may be, or include, at least one of an attachment assembly 128 (described in further detail below) and a target. The target may include, for example, a container such as, for example, a bottle (e.g., a soda bottle, a laundry detergent bottle, a milk bottle, etc.). According to embodiments, the elastic mounting interface 124 may have a conical shape, a truncated conical shape, pyramidal shape, a truncated pyramidal shape, and/or any other shape configured to provide an interference fit with a desired type of target.

In embodiments, for example, the elastic mounting interface 124 may be configured to hold a plastic or glass bottle that has a relatively wide mouth (e.g., a mouth having a diameter that is approximately equal to, or slightly smaller than, a diameter of the elastic mounting interface 124). That is, for example, as shown, the elastic mounting interface 124 may have a conical, tapered, body that includes a number of diameters 130 perpendicular to a central longitudinal axis 132 passing through the upper rod 110. In embodiments, the mouth of a bottle may be placed over the elastic mounting interface 124 such that an interference fit is achieved between an inner surface of the bottle and the outer surface 126 of the elastic mounting interface 124 at a location corresponding to a diameter 130 that is approximately the same as (or slightly larger than) an inner diameter of the mouth of the bottle. In embodiments, the elastic mounting interface 124 may be configured to receive any number of different types of bottles and/or other containers, based on the size and shape of the elastic mounting interface 124. For example, in embodiments, the elastic mounting interface 124 may be configured to receive targets having an inner diameter of greater than approximately one inch and less than approximately one and one half inches, although the elastic mounting interface 124 may be configured to receive targets (e.g., containers) having inner diameters of any desired size.

In embodiments, as shown, the elastic mounting interface 124 may include a cavity 134 defined in an upper surface 136 thereof. The cavity 134 may be configured to receive a mouth of a bottle that has a relatively smaller diameter (outer and/or inner diameter) such as, for example, a soda bottle. In embodiments, the cavity 134 may be configured to have any number of different shapes, sizes, and/or the like, so as to receive any number of different types of targets, sizes of containers, and/or the like. For example, in embodiments, the cavity 134 may be configured such that an inner surface of the cavity 134 provides an interference fit with an outer surface of a target (e.g., a bottle having a mouth with an outer diameter that is approximately equal to, or just smaller than, a diameter of the cavity 134. For example, in embodiments, the cavity 134 of the elastic mounting interface 124 may be configured to receive targets having an outer diameter of less than approximately one inch, although the cavity 134 may be configured to receive targets (e.g., containers) having outer diameters of any desired size.

As shown in FIG. 1B, and as mentioned above, the mounting assembly 112 may include an attachment assembly 128. The attachment assembly 128 includes a body 138 and one or more attachment devices 140, 142, 144 coupled to the body 138. The one or more attachment devices may include at least one of a clip 140, 142, a nail, and a screw 144. The attachment assembly 128 may be configured to be removably coupled to the elastic mounting interface 124. That is, for example, the attachment assembly 128 may include a cavity 146 defined in the body 138 that is configured to receive at least a portion of the elastic mounting interface 124, thereby coupling the attachment assembly 128, via an interference fit, to the elastic mounting interface 124. In embodiments, any number of other attachment techniques may be used for coupling the attachment assembly 128 to the upper rod 110. In embodiments, the attachment assembly 128 may be constructed from any number of different materials such as, for example, plastic, polyvinyl chloride (PVC), acrylonitrile butadiene styrene (ABS), and/or the like; and may be constructed using any number of different types of process such as, for example, extrusion, molding, three-dimensional printing, and/or the like.

According to embodiments, the attachment devices 140, 142, 144 may be configured to hold in place any number of different types of targets such as, for example, a bottle, a can, a paper plate, a lid, a clay target, a piece of cardboard, and/or the like. That is, for example, the clips 140, 142 may be configured to hold paper plates, lids, clay targets, cardboard, and/or the like. In embodiments, one or more of the clips 140, 142 may include serrated features (e.g., "teeth") or other friction-promoting mechanisms (e.g., rubber pads, sandpaper, etc.) on one or more surfaces thereof to facilitate gripping targets. The screw 144 (which, in embodiments, may be a nail or other projecting object) may be used for mounting metal cans, oversized metal and/or plastic containers, frozen food dishes, fruit, vegetables, and/or the like. That is, for example, the screw 144 (or other projecting object) may be configured to penetrate an object to hold it in place. In embodiments in which a screw 144 is used, a target may be penetrated by the screw 144 and then screwed down onto the screw 144 until it rests securely on a support (or set of supports). In embodiments, for example, the clip 142 may be the support, protrusions may extend upward from the clip 142 to serve as supports, supports separate from the clip 142 may be included on the attachment assembly 128, and/or the like.

As shown in FIG. 1B, the target system 100 also includes a shield assembly 148 coupled to the upper rod 110 and configured to be disposed between a shooter and the mounting assembly 112. In embodiments, the shield assembly 148 includes a shield 150 configured to protect the mounting assembly 112 and/or the attachment of a target and/or an attachment assembly to the upper rod 110 from being damaged by a projectile. In embodiments, the shield assembly 148 includes an attachment element 152 configured to facilitate coupling the shield 150 to the upper rod 110. As shown in FIG. 1B, the attachment element 152 may include a first end 154 coupled to a first side 156 (or intersection of surfaces) of the shield 150 and extending away from the first surface 156 of the shield 150. The attachment element 152 may also include a grommet 158 disposed within an aperture 160 disposed in the attachment element 152, where the grommet 158 is configured to be disposed around the upper rod 110 to hold the shield assembly 148 in place on the upper rod 110. In embodiments, the attachment element 152 may include, for example, an eye bolt with a rubber grommet disposed within the eye of the eye bolt.

The attachment element 152 may be removably or permanently coupled to the first side 156 of the shield 150 such as, for example, by welding attachment element 152 to the first side 156 of the shield 150. In embodiments, when the shield 150 is coupled to the upper rod 110, the shield 150 is rotatable about the upper rod 110. In this manner, the shield 150 may be swiveled into a position such that the shield 150 is disposed between the mounting assembly 112 and a shooter, with a second side 162 of the shield 150 facing the shooter. According to embodiments, the attachment element 152 may be configured to maintain the shield 150 in a position such that the outer surfaces of the shield (the surfaces facing the shooter) are oriented at approximately 45 degrees with respect to the ground. In this manner, upon being struck by a projectile, the projectile may be directed toward the ground. Additionally, upon being struck, the shield may be configured to swivel about the upper rod 110, thereby absorbing at least a portion of the force of impact.

Figure 1C:
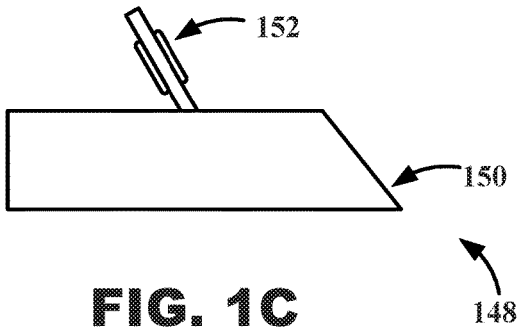
FIG. 1C is a side view of the shield assembly of the illustrative target system depicted in FIGS. 1A and 1B, in accordance with embodiments of the disclosure.
Figure 1D:
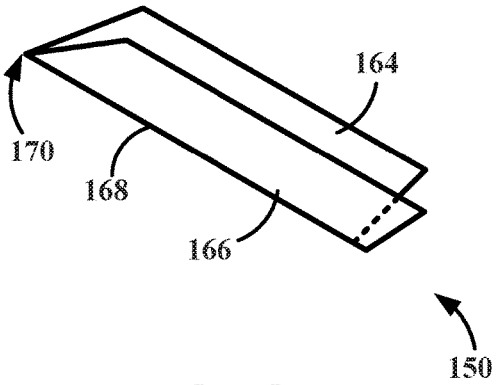
FIG. 1D is a perspective view of the shield of the shield assembly depicted in FIG. 1C, in accordance with embodiments of the disclosure.
Figure 1E:
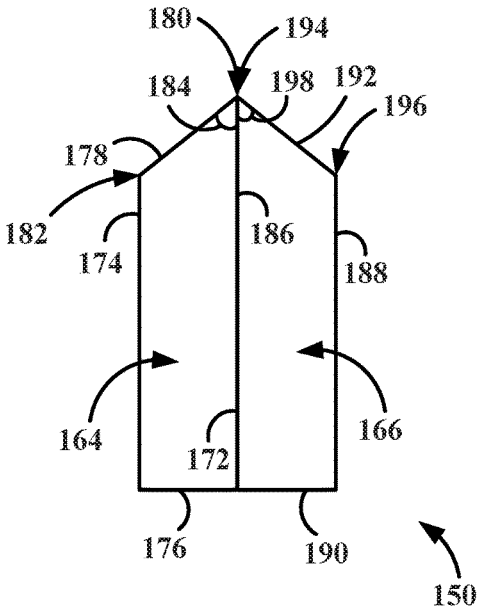
FIG. 1E is a front view of the shield depicted in FIG. 1D, in accordance with embodiments of the disclosure.

According to embodiments, the shield 150 may be configured according to any number of different shapes and sizes and may be made of any number of different types of materials. FIG. 1C is a side view of the shield assembly 148 depicted in FIGS. 1A and 1B; FIG. 1D is a perspective view of the shield 150; and FIG. 1E is a front view of the shield 150, in accordance with embodiments of the subject matter disclosed herein. According to embodiments, as shown in FIGS. 1C-1E, the shield 150 may include a first wall 164 and a second wall 166 extending away (e.g., at an angle) from an intersection edge 168 of the first wall 164. That is, for example, the first wall 164 and the second wall 166 may be approximately perpendicular to one another. Any number of other angles between corresponding surfaces and/or edges of the first and second walls 164 and 166 may be used in various embodiments. As shown, in embodiments, the walls 164 and 166 may be configured such that, at the intersection edge 168, the shield 150 forms a point 170.

That is, for example, the wall 164 may include a first side 172, a second, opposite and approximately parallel side 174; a third side 176 approximately perpendicular to the first and second sides 172 and 174; and a fourth side 178 extending between a first end 180 of the first side 172 and a first end 182 of the second side 174. In embodiments, the fourth side 178 is not parallel to the third side 176 and, in embodiments, may be configured such that an acute angle 184 is formed between the first side 172 and the fourth side 178. Similarly, the wall 166 may include a first side 186, a second, opposite and approximately parallel side 188; a third side 190 approximately perpendicular to the first and second sides 186 and 188; and a fourth side 192 extending between a first end 194 of the first side 186 and a first end 196 of the second side 188. In embodiments, the fourth side 192 is not parallel to the third side 190 and, in embodiments, may be configured such that an acute angle 198 is formed between the first side 186 and the fourth side 192. As shown, the first side 172 of the first wall 164 may be configured to be coupled to the first side 186 of the second wall 166, in which case, the first side 172 and the first side 186 form the intersection edge 168.

In embodiments, the attachment element 152 may be configured to extend from between the two walls 164 and 166 and may, in embodiments, be straight, curved, and/or a combination thereof. In embodiments, the shape of the attachment element 152 is configured such that, when the shield assembly 148 is coupled to the upper rod 110, the shield 150 is angled downward so that projectiles that hit the shield will be more likely to travel toward the ground after impact.

Figure 2A:
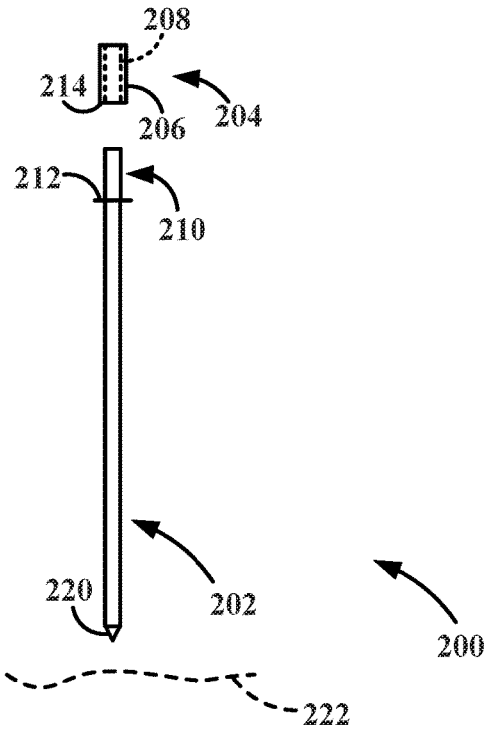
FIGS. 2A-2D depict an illustrative process of assembling an illustrative target system, in accordance with embodiments of the disclosure.
Figure 2B:
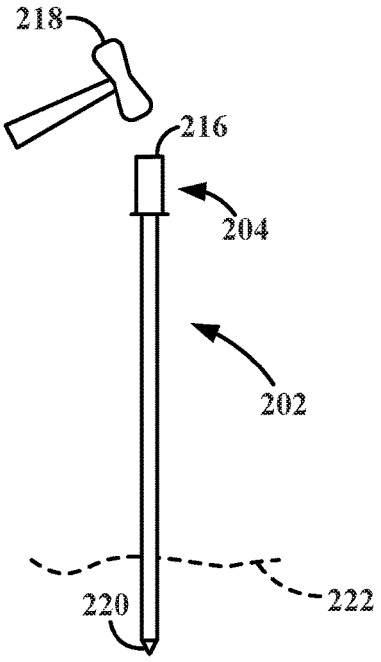

FIGS. 2A-2D depict an illustrative process of assembling an illustrative target system 200, in accordance with embodiments of the subject matter disclosed herein. According to embodiments, the illustrative target system 200 may be, be similar to, include, or be included in the target system 100 depicted in FIGS. 1A-1E. In embodiments, for example, the target system 200 may include a lower rod 202, which may be, include, be included in, or be similar to, the lower rod 102 depicted in FIGS. 1A and 1B. As shown in FIGS. 2A and 2B, the system includes a strike barrel 204 having a body 206. An aperture 208 is defined therethrough, and is configured to receive an upper portion 210 of the lower rod 202. As is further shown, the lower rod 202 further includes a stop surface 212 configured to engage a lower surface 214 of the strike barrel body 206. The stop surface 212 may be, for example, a collar disposed around the lower rod 202. The strike barrel 204 may include a strike surface 216 which, in embodiments and as shown, may be an upper surface of the strike barrel 204. In this manner, striking the strike surface 216 with a hammer 218 or other tool may cause the force of the strike to be transferred to the lower rod 202, driving the lower, tapered and/or sharp, point 220 of the lower rod 202 into the ground 222.

Figure 2C:
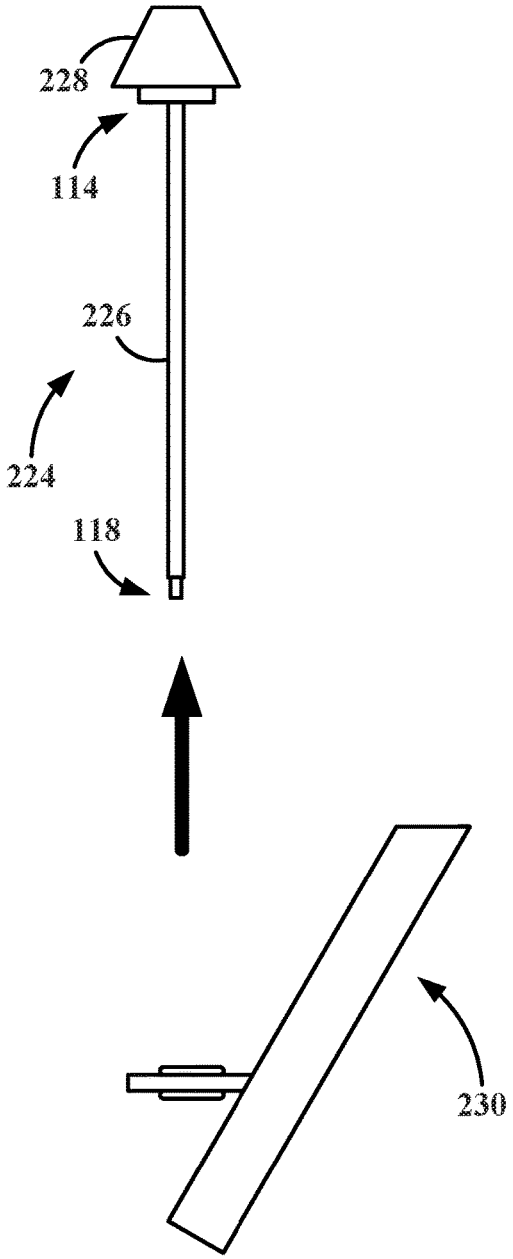
Figure 2D:
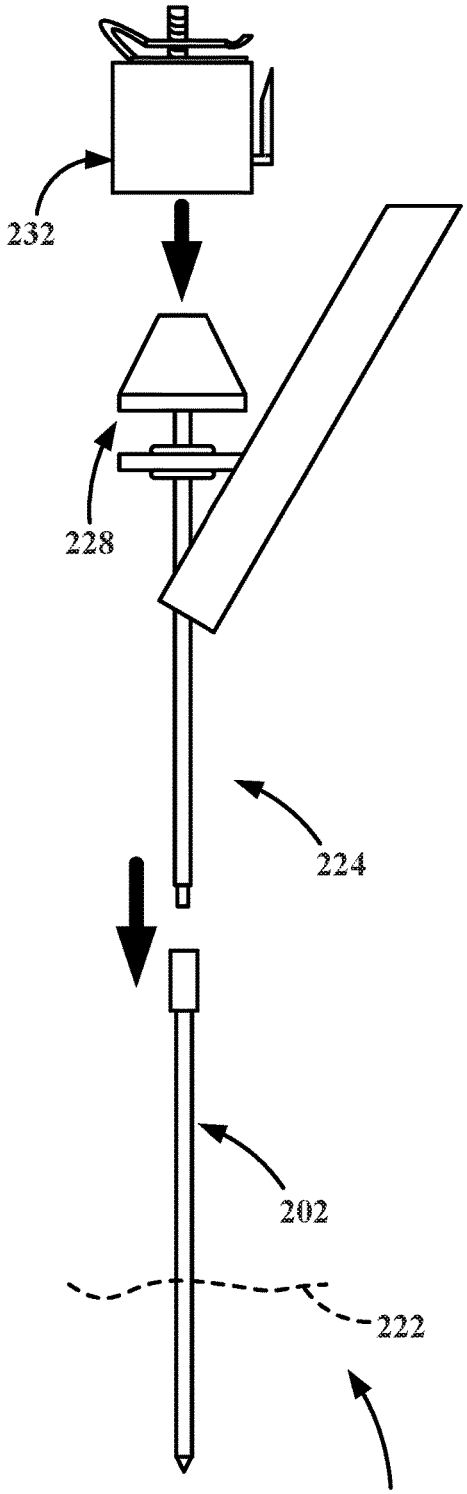

As shown in FIG. 2C, the target system 200 may also be provided with an upper rod assembly 224 having an upper rod 226 and an elastic mounting interface 228, and the assembly process further includes attaching a shield assembly 230 to the upper rod 226. As shown in FIG. 2D, the assembly process further includes coupling the upper rod assembly 224 to the lower rod 202. Embodiments of the assembly process may also include coupling a target and/or an attachment assembly 232 to the elastic mounting interface 228. According to embodiments, the assembly process depicted in FIGS. 2A-2D may be performed in any number of different sequences, include any number of different steps (including less or more steps than those described here), and/or the like.

The illustrative target systems 100 and 200 shown in FIGS. 1A-1E and 2A-2D, respectively, are not intended to suggest any limitation as to the scope of use or functionality of embodiments of the present disclosure, and should not be interpreted as having any dependency or requirement related to any single component or combination of components illustrated therein. Additionally, various components depicted in FIGS. 1A-1E and 2A-2E may be, in embodiments, integrated with various ones of the other components depicted therein (and/or components not illustrated), all of which are considered to be within the ambit of the present disclosure.

Figure 3:
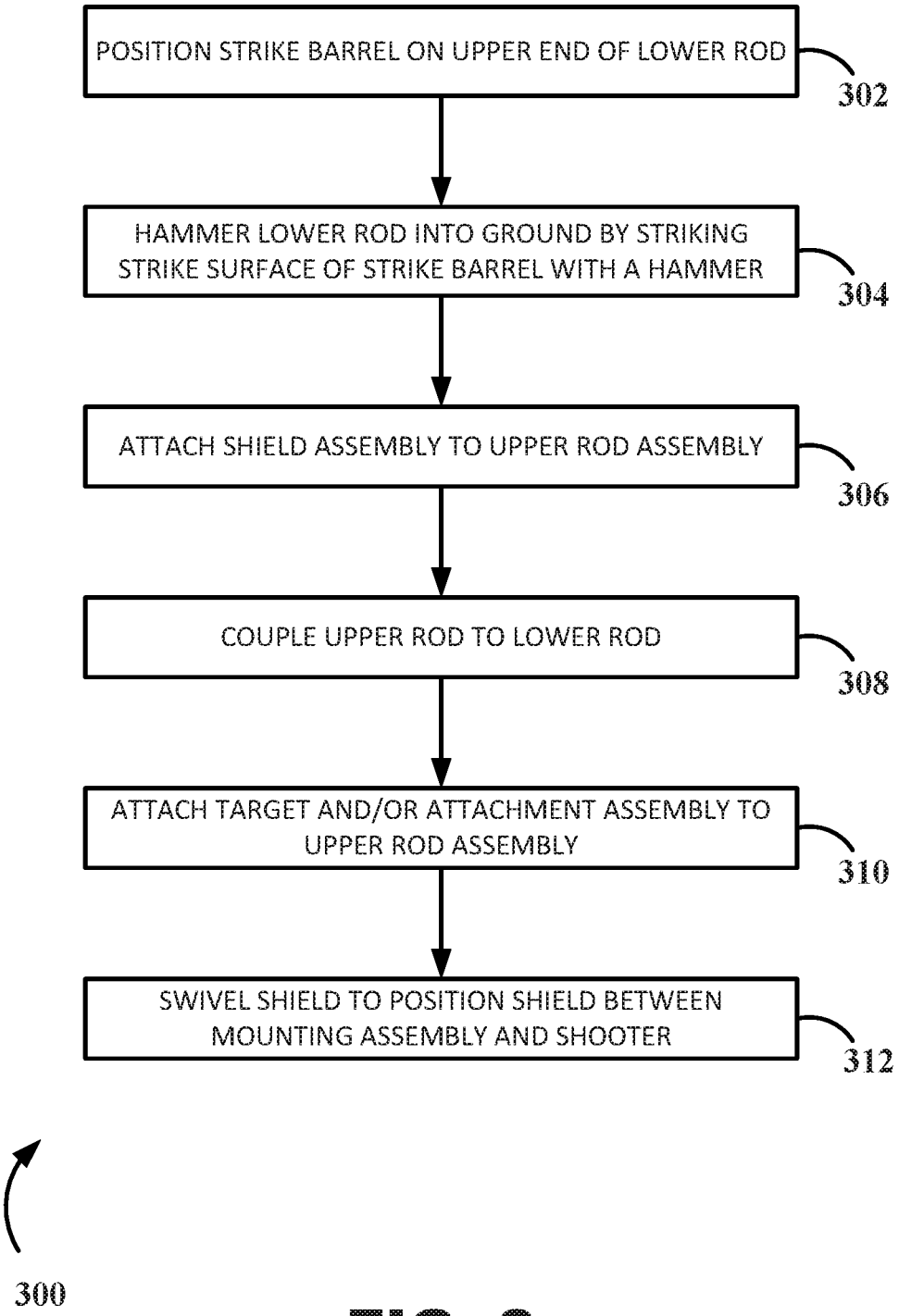
FIG. 3 is a flow diagram depicting an illustrative method of assembling a target system, in accordance with embodiments of the disclosure.

FIG. 3 depicts an illustrative method 300 of assembly a target system, in accordance with embodiments of the subject matter disclosed herein. According to various embodiments, the method 300 may be used to assemble the target system 100 depicted in FIGS. 1A-1B, the target system 200 depicted in FIGS. 2A-2E, and/or the like. As shown in FIG. 3, embodiments of the method 300 include positioning a strike barrel on an upper end of a lower rod (block 302) and hammering the lower rod into the ground by striking a strike surface of the strike barrel with a hammer (block 304). As is further shown in FIG. 3, embodiments of the method 300 include attaching a shield assembly to the upper rod assembly (306) and coupling the upper rod assembly to the lower rod (block 308). A target and/or attachment assembly may be attached to the upper rod assembly (block 310). Embodiments of the method 300 further include swiveling the shield assembly to position the shield between the mounting assembly and the shooter (block 312).

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

I claim:

1. A target system, comprising:

a lower rod configured to be removably inserted, at a lower end, into the ground; and an upper rod assembly, the upper rod assembly comprising:

an upper rod configured to be coupled, at a lower end, to an upper end of the lower rod;

a mounting assembly coupled to an upper end of the upper rod, the mounting assembly comprising an elastic interface, wherein the elastic mounting interface is configured to be compressible to facilitate providing an interference fit between an outer surface of the elastic mounting interface and an inner surface of a mounted object; and a shield coupled to the upper rod and configured to be disposed between a shooter and the mounting assembly, wherein, when the shield is coupled to the upper rod, the shield is rotatable about the upper rod; and wherein the shield is coupled to the upper rod via an attachment element, wherein a first end of the attachment element is coupled to an inside surface of the shield, the attachment element having a grommet disposed within an aperture disposed in the attachment element, wherein the grommet is configured to be disposed around the upper rod.

2. The target system of claim 1, the upper rod assembly comprising a first attachment interface disposed at a lower end of the upper rod, wherein the first attachment interface is configured to interact with a second attachment interface, wherein the second attachment interface is disposed at an upper end of the lower rod.

3. The target system of claim 1, wherein the lower rod further includes a tapered lower end configured to facilitate ground penetration.

4. The target system of claim 1, the lower rod further including a strike surface configured to facilitate hammering the lower rod into the ground.

5. The target system of claim 4, wherein the strike surface is an upper surface of a strike barrel, the strike barrel comprising a body having an aperture defined therethrough, the aperture configured to receive an upper portion of the lower rod.

6. The target system of claim 5, the lower rod further comprising a stop surface configured to engage a lower surface of the strike barrel body.

7. The target system of claim 1, the mounted object comprising at least one of an attachment assembly and a target.

8. The target system of claim 7, the attachment assembly comprising a body and one or more attachment devices coupled to the body.

9. The target system of claim 8, the one or more attachment devices comprising at least one of a clip, a nail, and a screw.

10. The target system of claim 7, wherein the target comprises at least one of a bottle, a paper plate, a lid, a clay target, and a piece of cardboard.

11. A method of assembling a target system, comprising:

inserting a lower rod into the ground;

attaching a shield assembly to an upper rod assembly, the upper rod assembly comprising:

an upper rod; and a mounting assembly coupled to an upper end of the upper rod;

coupling the upper rod assembly to the lower rod;

attaching a target and/or an attachment assembly to the mounting assembly; and swiveling the shield to a position between the mounting assembly and a shooter, wherein an entire surface of the shield facing the shooter is angled in a downward direction;

wherein the shield is coupled to the upper rod via an attachment element, wherein a first end of the attachment element is coupled to an inside surface of the shield, the attachment element having a grommet disposed within an aperture disposed in the attachment element, wherein the grommet is configured to be disposed around the upper rod, wherein attaching the shield assembly to the upper rod assembly comprises sliding the grommet over a lower end of the upper rod.

12. The method of claim 11, wherein inserting the lower rod into the ground comprises striking, with a hammer, a strike surface configured to facilitate hammering the lower rod into the ground.

13. The method of claim 12, wherein the strike surface is an upper surface of a strike barrel, the method further comprising positioning the strike barrel on an upper end of the lower rod, the strike barrel comprising a body having an aperture defined therethrough, the aperture configured to receive an upper portion of the lower rod, the lower rod further comprising a stop surface configured to engage a lower surface of the strike barrel body.

* * * * *